United States Patent [19]

Barton

[11] 4,455,918

[45] Jun. 26, 1984

[54] ELEVATION PROTRACTOR FOR TRUNNIONED GUNS

[75] Inventor: Norman P. Barton, Egham, England

[73] Assignee: Secretary of State for Defence in Her Britannic Majesty's Government of the United Kingdom of Great Britain and Northern Ireland, London, England

[21] Appl. No.: 387,055

[22] Filed: Jun. 10, 1982

[30] Foreign Application Priority Data

Jun. 15, 1981 [GB] United Kingdom ..... 8118336

[51] Int. Cl.[3] ..... F41C 9/00; F41H 13/00; G01B 3/30

[52] U.S. Cl. ..... 89/41 L; 33/1 PT; 33/125 C; 89/41 ME; 89/41 TV

[58] Field of Search ..... 89/41 M, 41 LE, 41 L, 89/41 H, 41 TV, 41 ME; 356/1, 356; 33/1 N, 1 PT, 125 C, 172 E; 73/167

[56] References Cited

U.S. PATENT DOCUMENTS 3,996,670 12/1976 Joyal ..... 33/1 PT X 4,025,197 5/1977 Thompson ..... 356/356

4,112,818 9/1978 Garehime ..... 89/41 TV

*Primary Examiner*—Donald G. Kelly

*Attorney, Agent, or Firm*—Pollock, VandeSande and Priddy

[57] ABSTRACT

A protractor for determining the elevation angle of a gun by direct measurement of the included angle between a first radius of a trunnion and a second radius of an associated trunnion bearing, includes a linearly extensible measuring device with digital output, pivotally attached to the trunnion and to the bearing at predetermined distances along the respective radii so as to extend between them as the subtense of the included angle, and a digital processor for deriving a measurement of the included angle from the subtense measurement provided by the measuring device. The digital processor provides an output which is particularly suitable for application to a fire control system, the measurements provided by the protractor being less sensitive to centering inaccuracies in the trunnion and its bearing than conventional angle transducers operating at a subsidiary bearing.

4 Claims, 2 Drawing Figures

ELEVATION PROTRACTOR FOR TRUNNIONED GUNS

Figures 1, 2:
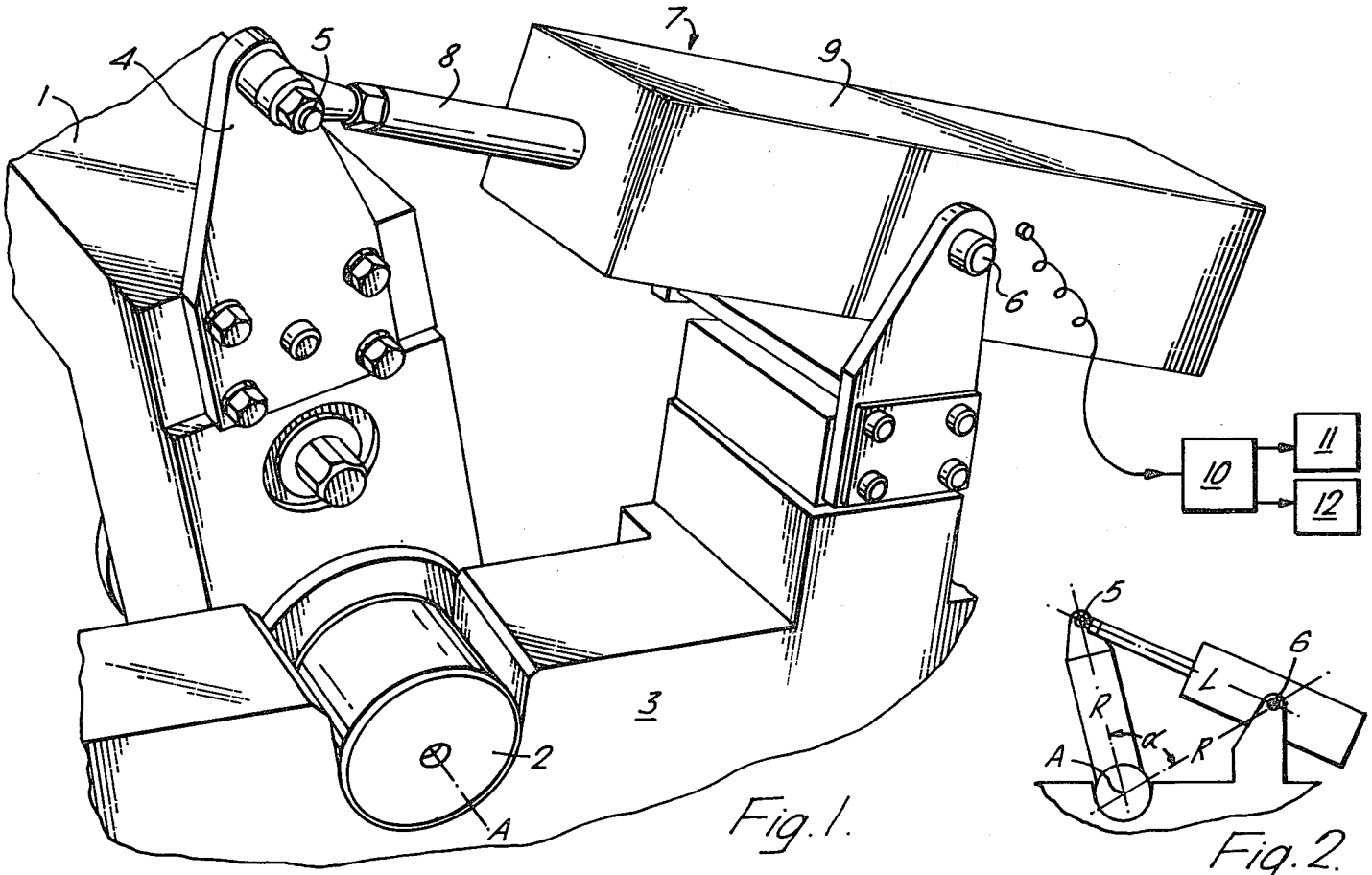

This invention relates to a protactor for measuring the angle of elevation of a trunnioned gun with respect to its bearings.

The angle included between any two pivotally interconnected members is normally measured by protractors having their own pivot and bearing respectively coupled to the pivot and bearing of the members i.e. the subject pivot and bearing, either in direct alignment or via linkages and gears. Errors in measurement can arise using such protractors if the subject pivot is not accurately centered within its bearings. Inaccurate centering causes the location of the axis of rotation to vary as the subject pivot turns in the bearing, with the result that the alignment of the separate protractor pivot cannot remain true for all angles of deflection and inaccurate incremental readings are obtained.

These inaccuracies are small but significant in the measurement of the elevation angle of a trunnioned gun, and are particularly disadvantageous when elevation information of high accuracy is required for use in a computerized fire control system for example. Electrical angle tranducers normally employed for this purpose have their own separate bearings coupled with those of the gun and are consequently subject to the aforesaid inaccuracies.

The present invention seeks to provide a protractor which is less sensitive to centering inaccuracies in the gun bearing by employing that same bearing for the protractor.

In accordance with the present invention a protractor for determining the elevation angle of a gun comprises a linearly extensible measuring device pivotally attachable to a trunnion of the gun and to an associated trunnion bearing at a predetermined distance along a respective radius of each so as to extend between the two radii as the subtense of the included angle, and a conversion means for deriving a measurement of the elevation angle from the subtense measurement provided by the measuring device.

Preferably the measuring device is an electrical transducer having a digital output, such as a linear optical grating encoder. The conversion means may then be a digital processor connected to the output of the encoder and programmed with the appropriate trigonometric relationship between an angle and its subtense, the length of the two defining radii being known and equal to the predetermined distances of the two attachment points of the measuring device from the trunnion axis and the bearing axis respectively. The longer these radii are made the greater the accuracy of measurement becomes, using a transducer of given sensitivity. For ease of calculation and simplicity of programming the two radii are preferably arranged to be equal.

The angular data provided by the processor may be displayed as a digital readout and may also be applied to further processor circuits for control purposes.

An embodiment of the invention will now be described by way of example only with reference to the accompanying drawings of which FIG. 1 is a perspective view of a protractor attached to a gun trunnion and bearing, and FIG. 2 is a diagrammatic representation of FIG. 1.

A gun barrel (not shown) is supported upon a cradle 1 attached to a trunnion 2 which is rotatable about an axis A in a bearing 3. A protractor arm 4 attached to the trunnion 2, via the cradle 1, bears a first pivot 5 at a radius R from the axis A (see FIG. 2). A second pivot 6 is attached to the bearing 3 also at a radius R from the axis A.

A linear optical grating encoder 7 having two telescopic portions 8 and 9 extends between the protractor arm 4 and the bearing 3, the portion 8 being rotatably attached to the first pivot 5 and the portion 9 being rotatably attached to the second pivot 6.

The encoder 7 generates an electrical output containing digital data indicative of the linear measurement of the distance L between the pivots 5 and 6, which data is entered into a digital processor 10 where it is converted to data indicative of angular measurement in accordance with the trigonometric relationship $\alpha=2\text{-}(\mathrm{Sin}^{-1}L/2R)$, $\alpha$ being the included angle between the two radii R. The angular information presented by the processor 10 can be referred to any desired reference radius by appropriate adjustment of the encoder 7 in an initial setting-up procedure, thus permitting direct indication of the angle of elevation. This information is further displayed in a readout device 11 and/or entered into a fire control computer system 12.

This embodiment has been found capable of an accuracy of plus or minus 0.003° over an angular range of 30° using a radius length R of 400 mm.

I claim:

1. An elevation protractor comprising a gun cradle including an opposed pair of trunnions having a common trunnion axis, each of said trunnions being pivotably located in a respective trunnion bearing so as to be rotatable substantially about the trunnion axis, one of said trunnions being provided with a pivot which is disposed substantially axially parallel to the trunnion axis and radially spaced therefrom, the respective trunnion bearing of said one of said trunnions being provided with a second pivot which is disposed substantially axially parallel to the trunnion axis and radially spaced therefrom, a linearly extensible measuring device having two telescopically engaged portions each rotatably attached to a respective one of the said two pivots so as to extend therebetween, said measuring device being operative to provide a linear measurement of the separation of said two pivots, and conversion means for converting said linear measurement into an angular measurement of the angle subtended at the trunnion axis by the said two pivots.

2. An elevation protractor as claimed in claim 1 wherein the measuring device is an electrical transducer having a digital output, the conversion means being a digital processor.

3. An elevation protractor is claimed in claim 2 wherein the transducer is an optical grating encoder.

4. An elevation protractor as claimed in claim 2 wherein the output of the digital processor is applied to a visual display unit.

* * * * *